US009850116B2

(12) United States Patent
Crane

(10) Patent No.: US 9,850,116 B2
(45) Date of Patent: Dec. 26, 2017

(54) CORK AND BOTTLE CAP REMOVING BULLET APPARATUS AND RELATED METHODS

(71) Applicant: Bottle Breacher LLC, La Jolla, CA (US)

(72) Inventor: Elijah Crane, Tucson, AZ (US)

( * ) Notice: Subject to any disclaimer, the term of this patent is extended or adjusted under 35 U.S.C. 154(b) by 340 days.

(21) Appl. No.: 14/586,674

(22) Filed: Dec. 30, 2014

(65) Prior Publication Data

US 2016/0185582 A1 Jun. 30, 2016

Related U.S. Application Data

(63) Continuation-in-part of application No. 29/513,169, filed on Dec. 29, 2014, now Pat. No. Des. 736,046.

(51) Int. Cl.
*B67B 7/04* (2006.01)
*B67B 7/44* (2006.01)
*B67B 7/16* (2006.01)

(52) U.S. Cl.
CPC ..... *B67B 7/0423* (2013.01); *B67B 7/0447* (2013.01); *B67B 7/16* (2013.01); *B67B 7/44* (2013.01)

(58) Field of Classification Search
CPC ..... B67B 7/0423; B67B 7/0447; B67B 7/16; B67B 7/44; B67B 1/02; B67B 29/025
See application file for complete search history.

(56) References Cited

U.S. PATENT DOCUMENTS

| | | | | |
|---|---|---|---|---|
| 4,759,238 | A * | 7/1988 | Farfalli | B67B 7/44 7/154 |
| 4,945,639 | A * | 8/1990 | Kirby | B26B 29/025 30/151 |
| 7,086,156 | B2 * | 8/2006 | McLaughlin | B26B 29/025 |
| 7,111,402 | B1 * | 9/2006 | Pearman | B26B 1/04 30/151 |
| 9,309,100 | B2 * | 4/2016 | Crane | B67B 7/16 81/3.55 |
| 2005/0072004 | A1 * | 4/2005 | Carter, III | B26B 1/02 30/158 |
| 2005/0097754 | A1 * | 5/2005 | Onion | B26B 1/02 30/159 |
| 2005/0132576 | A1 * | 6/2005 | Onion | B26B 1/02 30/158 |
| 2014/0338197 | A1 * | 11/2014 | Frazer | B26B 29/025 30/151 |

OTHER PUBLICATIONS http://www.swordnarmory.com/50-Caliber-Size-10-Long-Bullet-Style-Spring-Asss-p/sk-1400gd.htm, published as early as Apr. 22, 2014.*

* cited by examiner

*Primary Examiner* — David B Thomas
(74) *Attorney, Agent, or Firm* — Buche & Associates, P.C.; John K. Buche; Bryce A. Johnson

(57) ABSTRACT

Disclosed are various embodiments of an apparatus in the shape of a bullet for opening corked and capped bottles and methods of doing the same.

7 Claims, 6 Drawing Sheets

CORK AND BOTTLE CAP REMOVING BULLET APPARATUS AND RELATED METHODS

CROSS-REFERENCE TO RELATED APPLICATIONS

This application is a continuation-in-part to application Ser. No. 29/513,169 entitled "Design for a Wine Bottle Opener" filed on Dec. 29, 2014. The previous application is hereby incorporated by reference.

STATEMENT REGARDING FEDERALLY SPONSORED RESEARCH OR DEVELOPMENT

Not applicable.

BACKGROUND OF THE INVENTION

Wine is typically sealed in bottles with a cork. Cork is an impermeable material which compresses and can easily be inserted into a wine bottle. Once the cork is inserted into the wine bottle, the cork expands, forming a tight seal. Natural cork stoppers, along with synthetic cork, account for approximately 80% of wine bottle closures.

Because cork expands to form a tight seal, corks are difficult to remove from bottles. People have been using a corkscrew or a "worm" to remove a cork stopper since the $17^{th}$ Century. Over the years there have been numerous developments to the simple corkscrew to further aid wine drinkers in opening wine bottles.

There are many types of corkscrews available. However, very few of these products have the sleek appearance of a bullet. One bullet-shaped corkscrew bottle opener is made by Big Shot.[1] However, this particular opener does not feature a pivoting worm for safety and storage, nor does it feature a mechanism to provide additional leverage when opening a bottle. Thus, a need exists for a sleek bullet-shaped wine bottle opener with a worm that pivots for safety and storage, and has a mechanism for providing leverage when opening a wine bottle.

[1] http://www.amazon.com/Big-Sky-Carvers-Caliber-Corkscrew/dp/B00B4JKBJ6

SUMMARY OF THE INVENTION

In view of the foregoing, it is an objective of this application to describe various embodiments of an apparatus in the form of a cartridge opener for corked bottles and methods of using the same. Disclosed is an apparatus for opening a corked bottle comprising: a hollow bullet-shaped body featuring at least one aperture and a corkscrew shaped worm housed inside of the body, wherein the worm is connected to the body by a spring controlled hinge wherein the hinge allows the worm to pivot so that the worm can be moved and positioned at an angle approximately equal to 90 degrees relative to the body.

BRIEF DESCRIPTION OF THE DRAWINGS

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF THE INVENTION

In general, disclosed is a hollow bullet-shaped wine bottle opener featuring a corkscrew-shaped worm.

Figure 1:
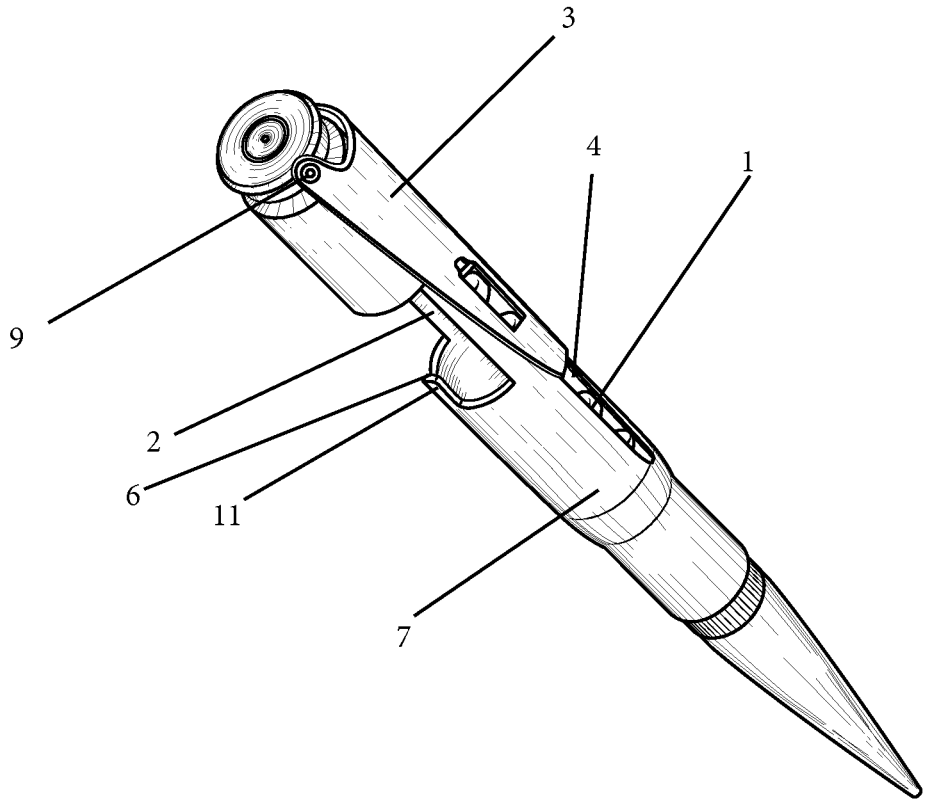
FIG. 1 is a perspective view of a wine bottle opener.

FIG. 1 is a perspective drawing of the preferred embodiment of a corkscrew bottle opener. The opener features a metal corkscrew-shaped worm 1 housed inside of hollow section 2 of a bullet-shaped body 7. The end (not shown) of the worm 1 is sharp and pointed. The worm is connected to the body 7 via a hinge (see FIG. 9). The body 7 features two apertures (4, 6) on the front side and the back side of the opener. The opener also features an arm 3 connected to the body 7 via a hinge 9. The hinge 9 allows the arm 3 to extend when the user needs to use the opener to open a wine bottle. In one embodiment, the bottle opener features a magnet (not shown) so a user can affix the opener to a refrigerator or other metallic surface for easy storage. In another embodiment, (not shown) the opener can be housed in a magnetized sheath.

As shown, a preferable embodiment has the appearance of a typical .50 caliber rifle cartridge and may be formed from a dummy round. This rifle round is well-respected in shooting communities, but also has sufficient weight and size to be an ideal lever for the purposes of opening wine bottles. Of course, this particular cartridge will not feature any gunpowder since the purpose of the cartridge is not actually for deployment in a weapon. Instead, the bullet is for the purpose of recreation and opening beverages in an efficient, gratifying, and stylish manner.

Figure 2:
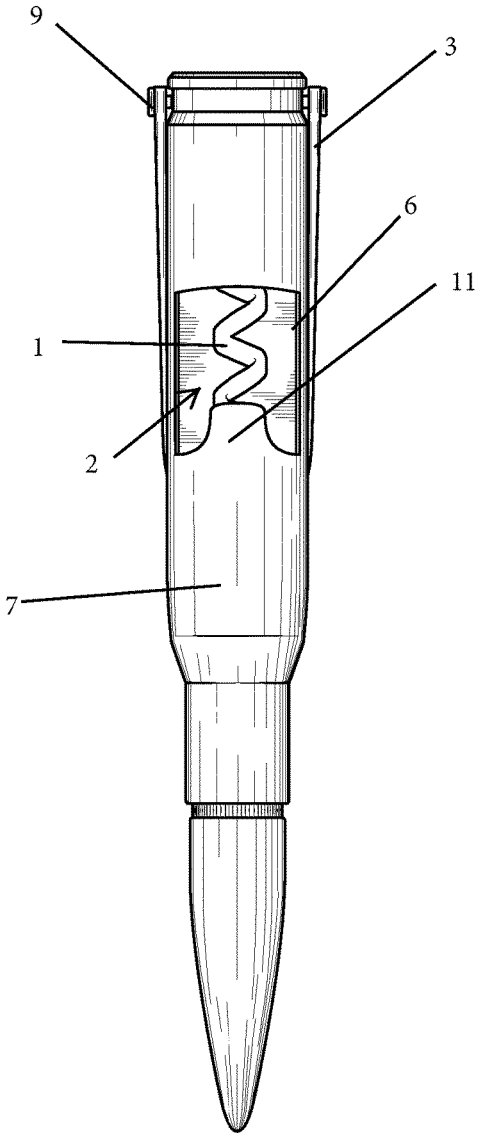
FIG. 2 is a front view of the wine bottle opener.

FIG. 2 is a front view of the opener. This view shows an additional feature of the preferred embodiment of the opener, namely a tooth 11 located on the front aperture 6. The tooth 11 is a protrusion on the front side of the opener. A user can open other types of bottles, specifically metal bottle caps commonly used on beer and soda bottles using the tooth 11. The user may invert the body 7 and removably secure the tooth 11 under a bottle cap. From that point, the tooth is a very efficient lever to swiftly remove a bottle cap.

Figure 3:
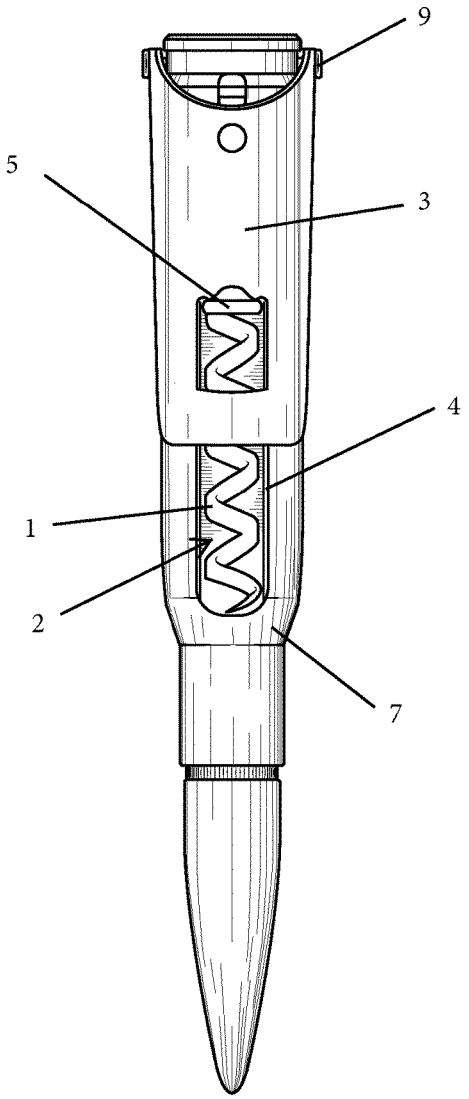
FIG. 3 is a back view of the wine bottle opener.
Figure 4:
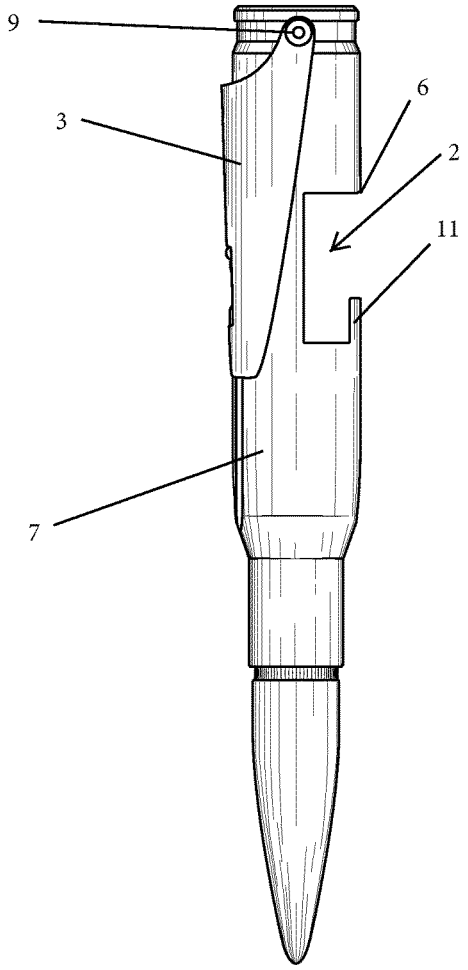
FIG. 4 is a left-side view of the wine bottle opener.
Figure 5:
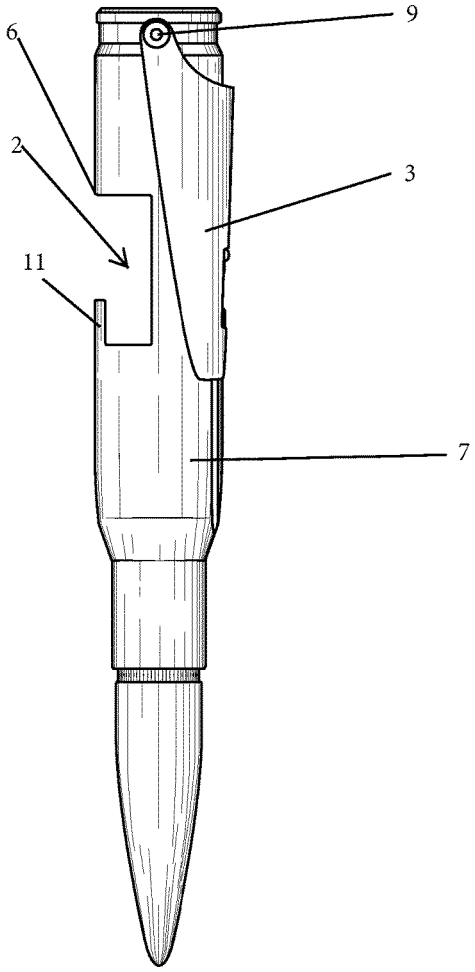
FIG. 5 is a right-side view of the wine bottle opener.
Figure 6:
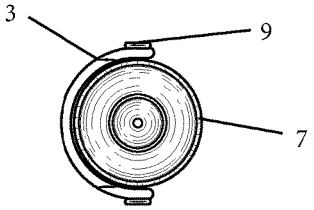
FIG. 6 is a top view of the wine bottle opener.
Figure 7:
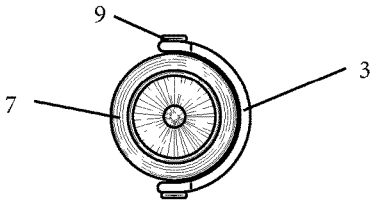
FIG. 7 is a bottom view of the wine bottle opener.

FIG. 3 is a back view of the bottle opener. FIGS. 4-7 show left-side, right-side, top, and bottle views of the opener respectively. These views show the arm 3 in detail. The arm 3 suitably features an opening which acts as a brace 5. In the preferred embodiment, the arm 3 is nested over the body 7. Nesting the arm 3 onto the body is preferable because it makes the opener easier to store. The brace 5 consists of an opening with the rim of the opening folded inward. The brace 5 provides additional leverage when opening a bottle. The arm 3 features a crescent shaped top so that the arm 3 can fully extend and clear the top of the body 7 when the arm 3 is pivoted. This view shows the placement of the worm 1 inside of the hollow area 2 of the body 7. In the preferred embodiment, the back aperture 4 is narrow and slightly longer than the length of the worm 1 so that there is enough room for the worm 1 to extend from the body 7 via a spring (see FIG. 8). When the opener is not in use, the opener should be stored with the worm 1 inside of the hollow area 2 of the body 7. This is because the end of the worm 1 is sharp, and housing it inside of the body 7 reduces the chances that a user will accidentally be injured from the sharp portion of the worm 1. Furthermore, storing the opener with the worm 1 housed inside of the body 7 is more compact and takes up less space. In addition, this configuration allows the opener to be stored with the appearance of a bullet.

Figure 8:
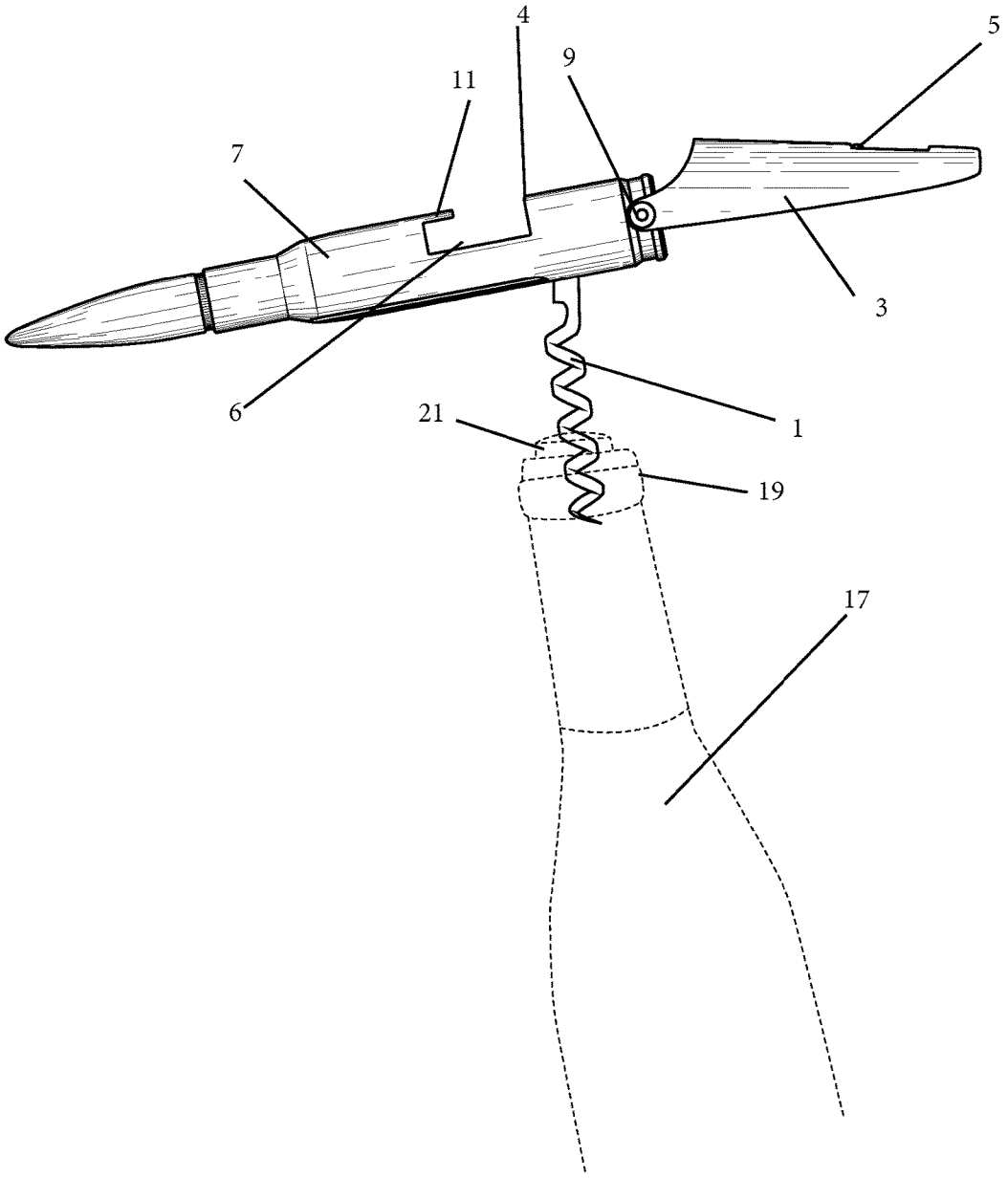
FIG. 8 is an environmental view of the wine bottle opener.
Figure 9:
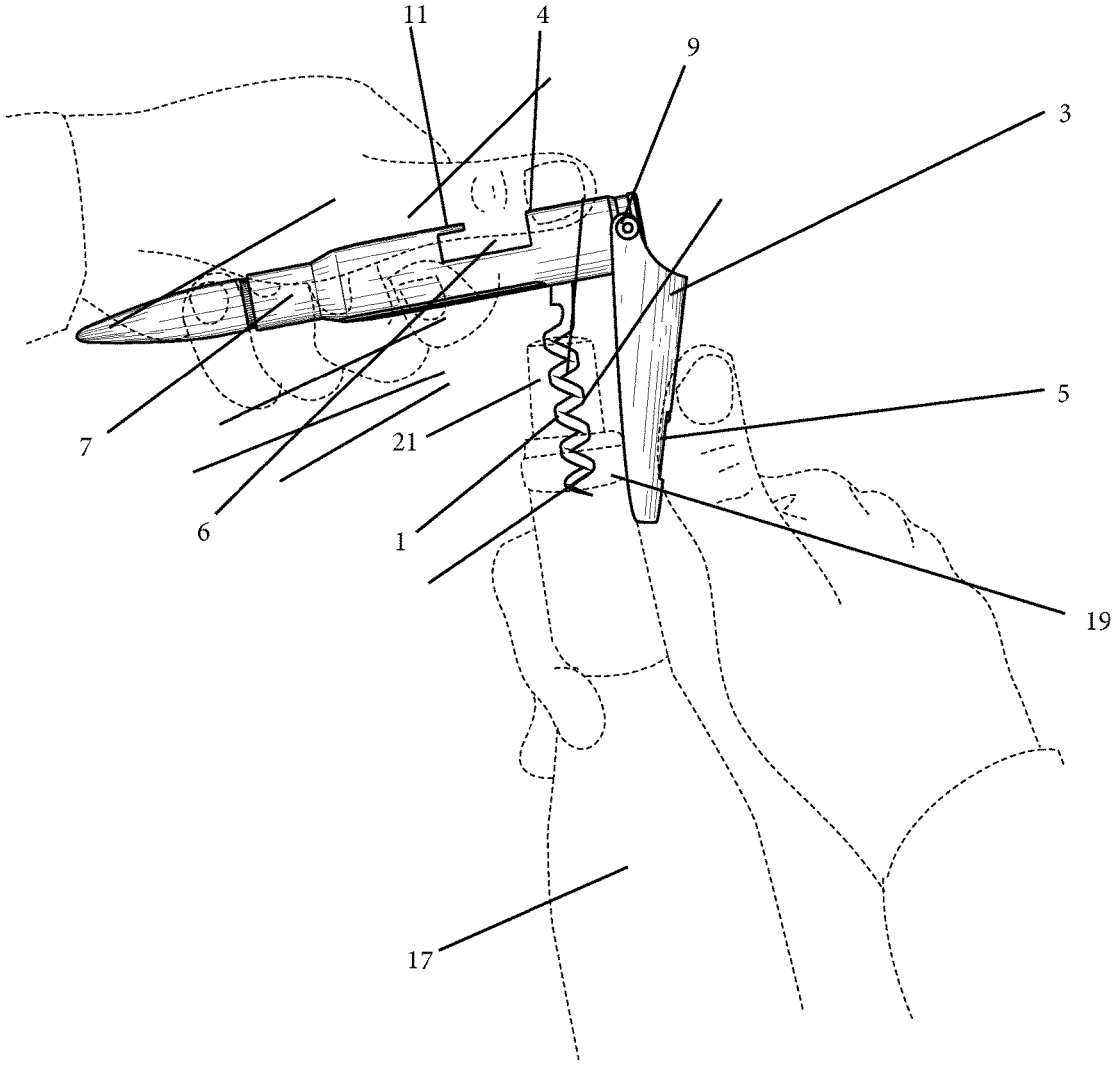
FIG. 9 is an environmental view of the wine bottle opener.

FIGS. 8 and 9 are environmental views that show how the opener can be used to open a wine bottle 17. A user first extends the arm 3 so that the user can retrieve the worm 1 from the hollow area 2. The user then pulls the worm 1 through the aperture 4 so that the worm 1 is approximately ninety degrees relative to the body 7, as shown. A user then inserts the worm 1 into the cork 21 using the pointed end of the worm 1. The user then twists the body 7 of the opener so that the worm 1 bores into the cork 21. Once the worm is deep enough into the cork 21, the user lifts the opener upwards to remove the cork 21. In the alternative, the user bends the arm 3 using the hinge 9, so that the brace 5 of the arm 3 rests against the lip 19 of the wine bottle 17, which is shown in FIG. 9. When the user rests the brace 5 against the lip 19, the user the pushes down on the arm 3 and up on the body 7. Using the arm 3 in this manner provides greater leverage when opening the bottle 17, making removal of the cork 21 easier and smoother.

Figure 10:
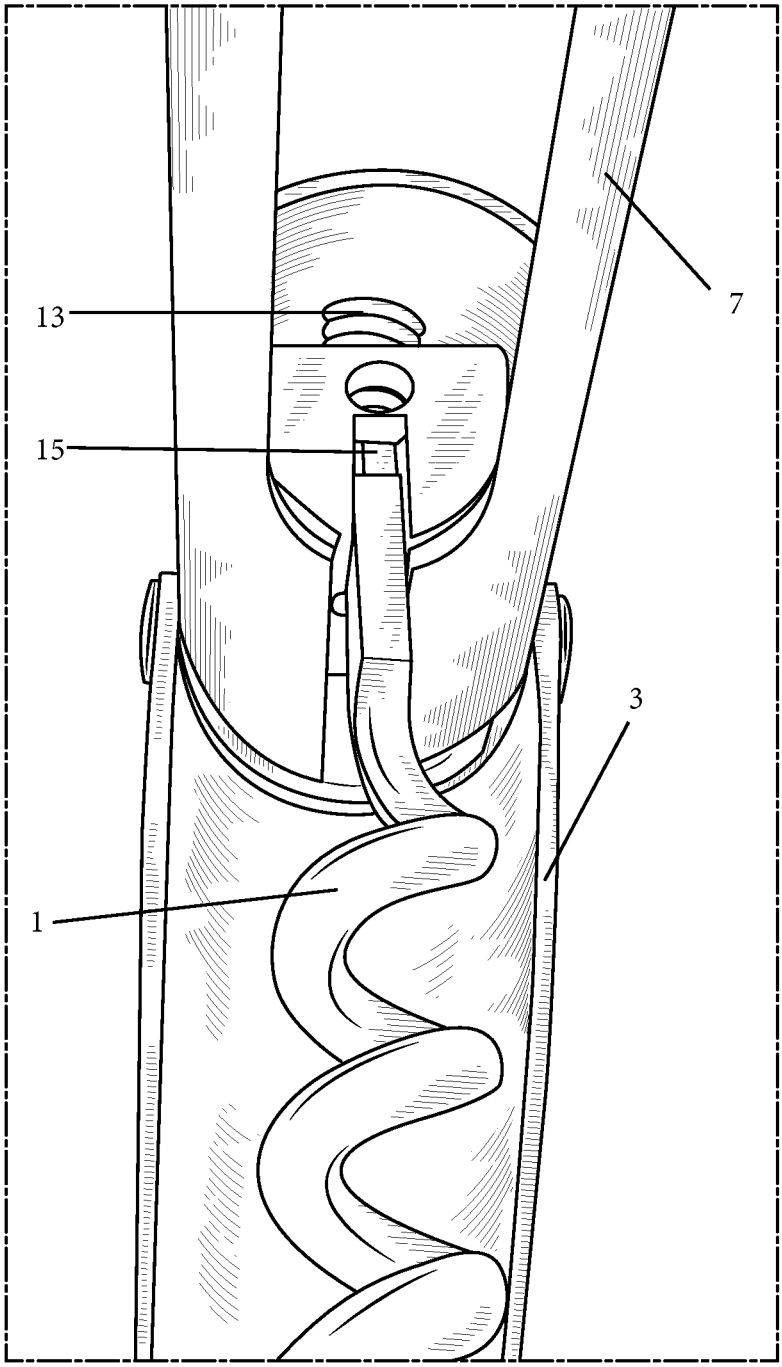
FIG. 10 is a close-up view of the spring hinge connecting the worm to the body of the opener.

FIG. 10 shows a close up view of corkscrew hinge 15 device that connects the worm 1 to the body 7 of the opener. The hinge 15 is housed inside the body 7. The corkscrew hinge 15 is controlled by a spring 13 that compresses when the worm 1 is extended outside of the body 7.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical, or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects, and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts, and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims, as originally filed, are hereby incorporated into the specification by reference.

I claim:

1. An apparatus for opening a corked bottle comprising:

a large caliber rifle cartridge-shaped body, wherein the body is hollow;

a first aperture in the body;

a second aperture in the body capable of opening a capped bottle, wherein the second aperture features a tooth;

an arm pivotally connected to the body, wherein the arm features a brace that may rest against the lip of a bottle, wherein the arm is defined by an arc shaped cut out on the end of the arm that is connected to the body, whereby the arm can substantially pivot around the end of the cartridge-shaped body and still lie flush against the body, whereby the apparatus resembles a bullet when the arm is flush against the body; and a metal corkscrew shaped worm housed inside of the hollow body, wherein the worm is hingedly connected to the body via a spring controlled hinge so that the worm may pivot and be positioned at approximately perpendicular position relative to the body.

2. An apparatus according to claim 1 wherein the body is the size and shape of a .50 caliber rifle cartridge.

3. An apparatus according to claim 1 featuring a magnet.

4. An apparatus according to claim 1 further comprising a housing sheath.

5. An apparatus according to claim 4 wherein the housing sheath features a magnet.

6. A method of opening a corked bottle comprising:

obtaining a corkscrew device wherein a worm is housed in a hollow bullet-shaped body;

pivoting the worm so that the worm is approximately perpendicular to the body;

inserting the end of the worm into a cork;

turning the body so that the worm bores into the cork;

adjusting the position of an arm, so that the arm rests against the lip of the bottle;

pulling upwards on the body and pushing down on the arm, so that the cork is removed; and, storing the corkscrew device on a magnetized surface after cork removal.

7. A method of removing a cork according to claim 6 further comprising obtaining a bottle featuring a cap;

inserting the a tooth underneath the cap; and, leveraging the tooth to remove the cap.

* * * * *